US007101202B2

(12) United States Patent
Fan

(10) Patent No.: US 7,101,202 B2
(45) Date of Patent: Sep. 5, 2006

(54) CONNECTOR WITH POST MEMBER FOR OPENING SHUTTER OF MATING CONNECTOR

(75) Inventor: Chia Hao Fan, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/114,591

(22) Filed: Apr. 25, 2005

(65) Prior Publication Data

US 2006/0014423 A1 Jan. 19, 2006

(30) Foreign Application Priority Data

Jul. 16, 2004 (JP) ..... 93211260 U

(51) Int. Cl.
*H01R 13/44* (2006.01)

(52) U.S. Cl. ..... 439/137

(58) Field of Classification Search ..... 439/137, 439/135, 139, 141, 374
See application file for complete search history.

(56) References Cited

U.S. PATENT DOCUMENTS 5,779,491 A * 7/1998 Nagano et al. ..... 439/141
6,036,503 A * 3/2000 Tsuchida ..... 439/70
6,877,999 B1 * 4/2005 Hashimoto ..... 439/138
6,896,530 B1 * 5/2005 Nishio et al. ..... 439/137
6,908,319 B1 * 6/2005 Sasame et al. ..... 439/137
2002/0177336 A1 * 11/2002 Sasame et al. ..... 439/142
2003/0077929 A1 * 4/2003 Funatsu ..... 439/137
2004/0092145 A1 * 5/2004 Sasame et al. ..... 439/137

FOREIGN PATENT DOCUMENTS

CN 1291808 A 4/2001

* cited by examiner

*Primary Examiner*—Tulsidas C. Patel
*Assistant Examiner*—Harshad Patel
(74) *Attorney, Agent, or Firm*—Wei Te Chung

(57) ABSTRACT

An electrical connector (1) includes a housing (11) having a mating portion (112) defining a mating direction, contacts (13) received in the mating portion of the housing, and a post member (14) disposed beside the mating portion. The post member includes a fixed portion (141), a movable portion (143), and an elastic portion (142) linking the fixed portion and the movable portion. The fixed portion and the movable portion define a first engaging state where the movable portion being immovable along the mating direction and a second engaging state where the movable portion being free to move along the mating direction. The movable portion has an actuating portion (162) for receiving a force to drive the movable portion to move from the first engaging state to the second engaging state along a direction substantially perpendicular to the mating direction.

18 Claims, 9 Drawing Sheets

CONNECTOR WITH POST MEMBER FOR OPENING SHUTTER OF MATING CONNECTOR

BACKGROUND OF THE INVENTION

1. Field of the Invention

The present invention relates to an electrical connector with post member for opening a shutter of a mating connector.

2. Description of Related Art

Electrical connectors are widely used for making electrical contacts within an electrical system or between electrical systems. In a typical arrangement, an electrical connector has a mating connector fitting section with a plurality of electrical contacts therein. The mating connector fitting section is configured to fit in a mating connector. However, when the mating connector is not fitted into the mating connector fitting section, the mating connector fitting section is exposed. Thus, foreign matter may enter the exposed mating connector fitting section and adhere to the contacts, whereby electrical connection may be interrupted or compromised when the mating connector is fitted in.

To protect the electrical connector from foreign matter, it may be provided with a shutter member to cover the mating connector fitting section. The shutter member is configured to freely open and close.

An electrical connector assembly with such a shutter for protecting from foreign matter generally comprises a receptacle and a plug that is mating with the receptacle. The receptacle has a plug fitting section and a shutter covering the plug fitting section. The plug has a post member for opening the shutter to expose the plug fitting section of the receptacle, and a mating portion for being fitted into the plug fitting section. Wherein the post member is usually a pair of post pins. However, for opening the shutter to expose the mating portion of the receptacle and permit the mating portion to enter, the post member is required to reach the shutter before a top face of the mating portion. Thus the post member has to stand higher than the top face of the mating portion along a mating direction of the plug. That requires a heightened receptacle for receiving the whole post member. Thus the dimension of the assembly will increase, which falls short of presently increasing requirement of size-minimizing of electrical component. If not heighten the receptacle, when the plug is received in and electrically connecting the receptacle, the post member will extend beyond a bottom face of the receptacle along the mating direction, into a printed circuit board (PCB) on which the receptacle is mounted. That requires the PCB to provided recesses to receive a peak of the post member that goes beyond the receptacle. This requirement will complicate a layout of the printed circuit.

Another such kind of electrical connector assembly with post member is disclosed in Chinese Patent Application Publication No. 1291808. The connector assembly disclosed has a similar structure to the above-described assembly except for having an elastic post member. The elastic post member comprises a pair of posts, each of which is driven by a coil spring and movable along the mating direction. So while mating the plug and the receptacle, tip portions of the posts come into abutting bottom faces of post-receiving recesses in the receptacle, so that the coil springs are compressed, making the posts completely received in the receptacle but no longer extending into the PCB. Now there is no need to heighten the receptacle or provide recesses in the PCB for receiving the post member. That's up to the requirement of minimizing the dimension of the assembly and simplifying the layout of the printed circuit.

However, as the post member is driven by the coil spring, if the spring is not strong enough, a force provided by the post member may be insufficient to open the shutter or may not ensure the shutter be opened fully and properly, especially after repeated employment. But if the spring is very strong, when the tip portion of the post comes into contact with the bottom face of the post-receiving recess in the receptacle during mating the plug and the receptacle, the coil spring is compressed and producing a strong force $F_1$ against the post, thus the being inserted plug has to resist both the force $F_1$ and a friction force $F_2$ produced between the mating portion of the plug and the plug fitting section of the receptacle, which increases the difficulty of the mating action. Moreover, the exist of the force $F_1$ between the mated plug and receptacle will result in the plug apt to disengage with the receptacle, or even cause the plug to be pushed out once if the force $F_1$ is greater than the friction force $F_2$.

To overcome above-motioned problems, a new connector with an improved post member is desired.

SUMMARY OF THE INVENTION

An object of the present invention is to provide an electrical connector assembly having a shutter and a post member for opening the shutter but without increasing size or complicating a layout of the PCB on which the connector is mounted.

Another object of the present invention is to provide an electrical connector with a shutter and a mating connector with a post member, wherein the post member could open the shutter fully and properly to let the mating connector to enter.

Accordingly, to achieve the above object, a connector assembly of present invention includes a first connector and a second connector mating with the first connector. The first connector has a mating connector fitting section with a plurality of contacts therein and a shutter member closing the mating connector fitting section. The second connector has a mating portion with a plurality of contacts therein and a post member for opening the shutter member to expose the mating connector fitting section of the first connector. The post member includes a fixed portion, a movable portion movable relative to the fixed portion, and an elastic portion linking the fixed portion and the movable portion. The fixed portion and the movable portion defining a first engaging state where the movable portion being immovable along the mating direction and a second engaging state where the movable portion being free to move along the mating direction. The movable portion having an actuating portion for engaging with an actuating member in the first connector to actuate the movable portion to move from the first engaging state to the second engaging state along a direction substantially perpendicular to the mating direction.

Other objects, advantages and novel features of the present invention will become more apparent from the following detailed description of the present embodiment when taken in conjunction with the accompanying drawings.

DETAILED DESCRIPTION OF THE INVENTION

Figure 1:
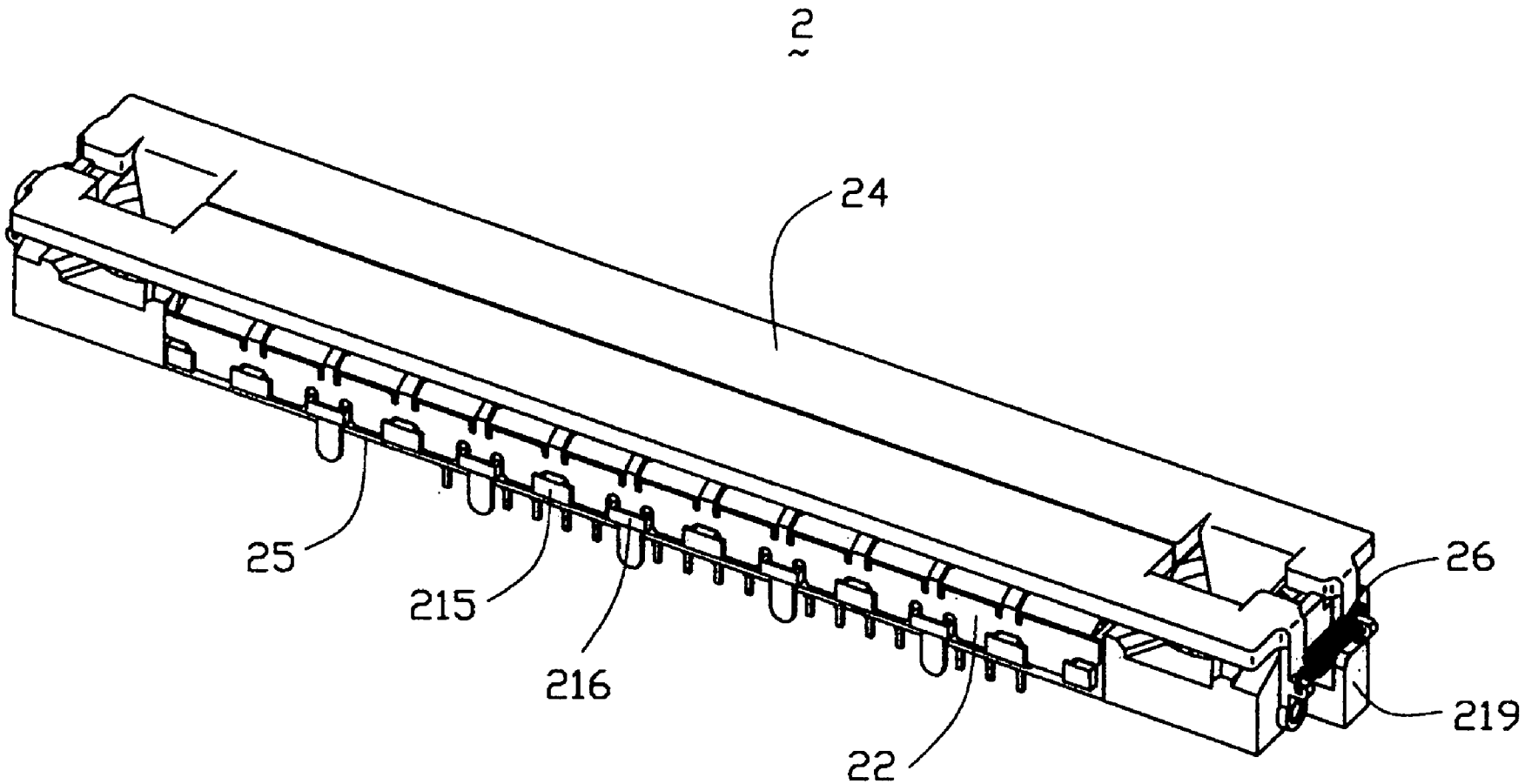
FIG. 1 is a perspective view of a receptacle with a shutter member according to an exemplary embodiment of the present invention.

Reference will now be made to the drawing figures to describe the present invention in detail.

The present invention relates to an electrical connector electrically connected to a mating connector to realize signal transmitting therebetween. According to an exemplary embodiment of the present invention, shown in FIGS. 1–8, that electrical connector is a plug 1 and the mating connector is a receptacle 2, each electrically connecting to a printed circuit board (PCB).

Figure 2:
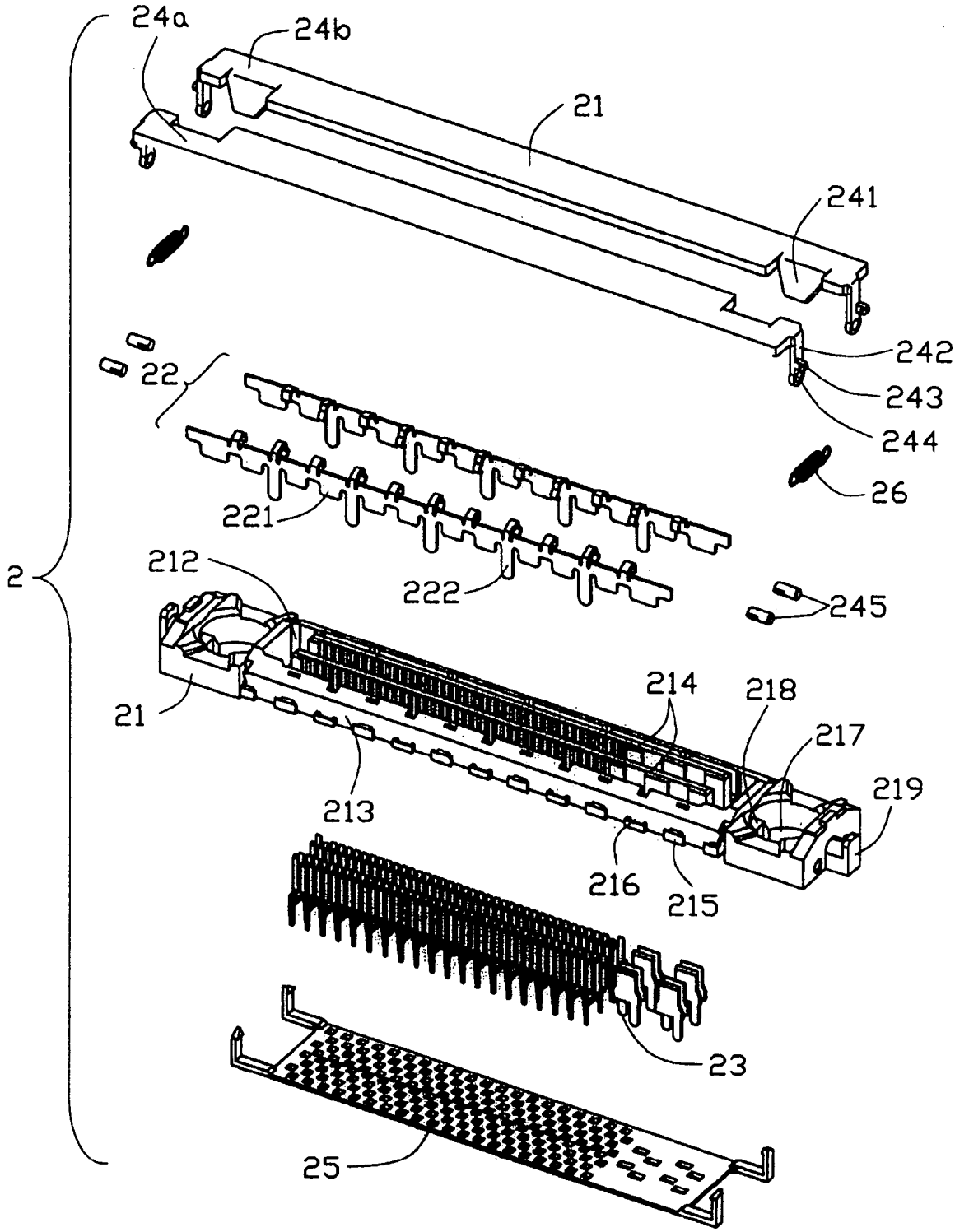
FIG. 2 is an exploded view of the receptacle of FIG. 1.

Referring to FIGS. 1 and 2, the receptacle 2 comprises a lengthways housing 21, a shielding shell 22, a plurality of contacts 23 received in the housing 21, and a shutter member 24. The housing 21 is of a substantially minimized height for exactly accommodating a mating portion 112 of the plug 1 (shown in FIG. 4) and includes a plug fitting section 212 and a pair of guiding holes 217 respectively defined in two end portions therethough. The plug fitting section 212 having mating tongues 214 therein on which the contacts 23 is arranged. First protuberances 215 and second protuberances 216 are alternately arranged in a row on sidewalls 213 of the plug fitting section 212. Each of the second protuberances 216 defines a slot therethrough along a top-to-bottom direction for receiving a grounding leg 222 of the shielding shell 22. The shielding shell 22 is attached on the exterior of the sidewalls 213, with its retain pieces 221 fitted into the intervals between the first and second protuberances, its grounding legs 222 inserted into the slots of the second protuberances 216. Tines of the contacts 23 and the grounding legs 222 extend through the bottom surface of the housing 21. A tine plate 25 is attached to the bottom surface of the housing 21 to align tips of the tines.

The shutter member 24 comprises a pair of metallic sheets 24*a*, 24*b* linked by a spring 26. Corresponding to the guiding holes 217 in the housing 21, at each end portions of the shutter member 24, there is a pair of guiding plates 241 integrally formed from the metallic sheets 24*a*, 24*b* and tipping down towards the guiding holes 217. Pivot legs 242 extend down from each ends of the metallic sheets 24*a*, 24*b*, and each pivot leg 242 has a lock member 243 for clipping the end of the spring 26 and a keyhole 244 for forelocking the shutter member 24 to the housing 21. In assembly, the spring 26 is supported by a hook-like member 219 formed from two ends of the housing 21, and the keyhole 244 aligns with a corresponding hole (not labeled) in the housing 21 to receive a shaft 245 in, so that the metallic sheets 24*a*, 24*b* are rotatably fastened to the housing 21, covering the plug fitting section 212.

Figure 3:
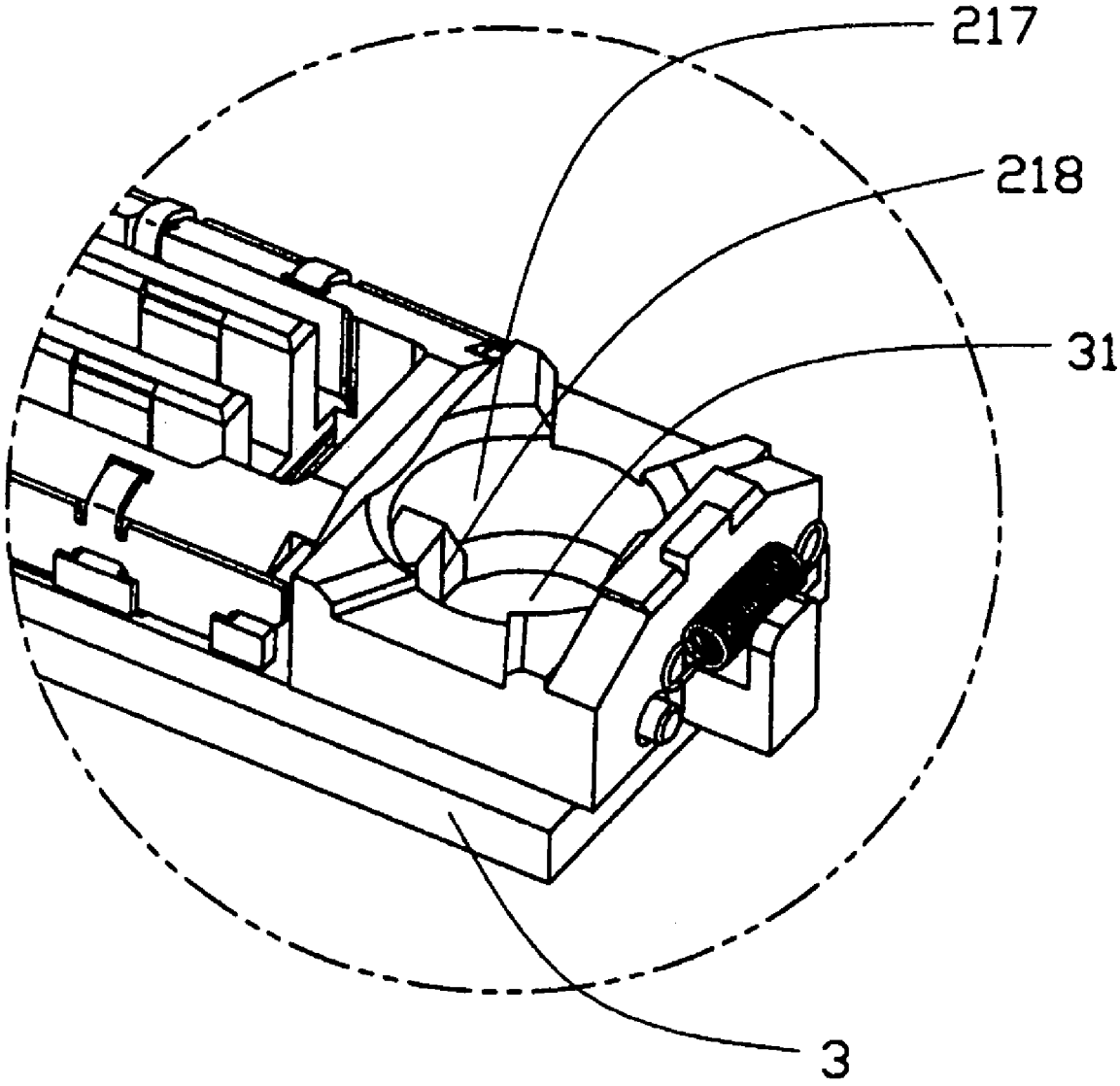
FIG. 3 is a partial magnified view of the receptacle of FIG. 1 after being mounted onto a printed circuit board (PCB), wherein the shutter member is removed.

Referring to FIG. 3, when the receptacle 2 is mounted on a PCB 3 now, the PCB 3 back covers the guiding hole 217 therethrough. Just on the PCB 3 under that guiding hole 217 there is a pad 31 functions as a conductor for contacting with another conductor of the plug 1 to prevent electrostatic discharge. And there is a pair of wedgy blocks 218 formed on the inner surface of the guiding hole 217 adjacent to the underlying PCB 3.

Figure 4:
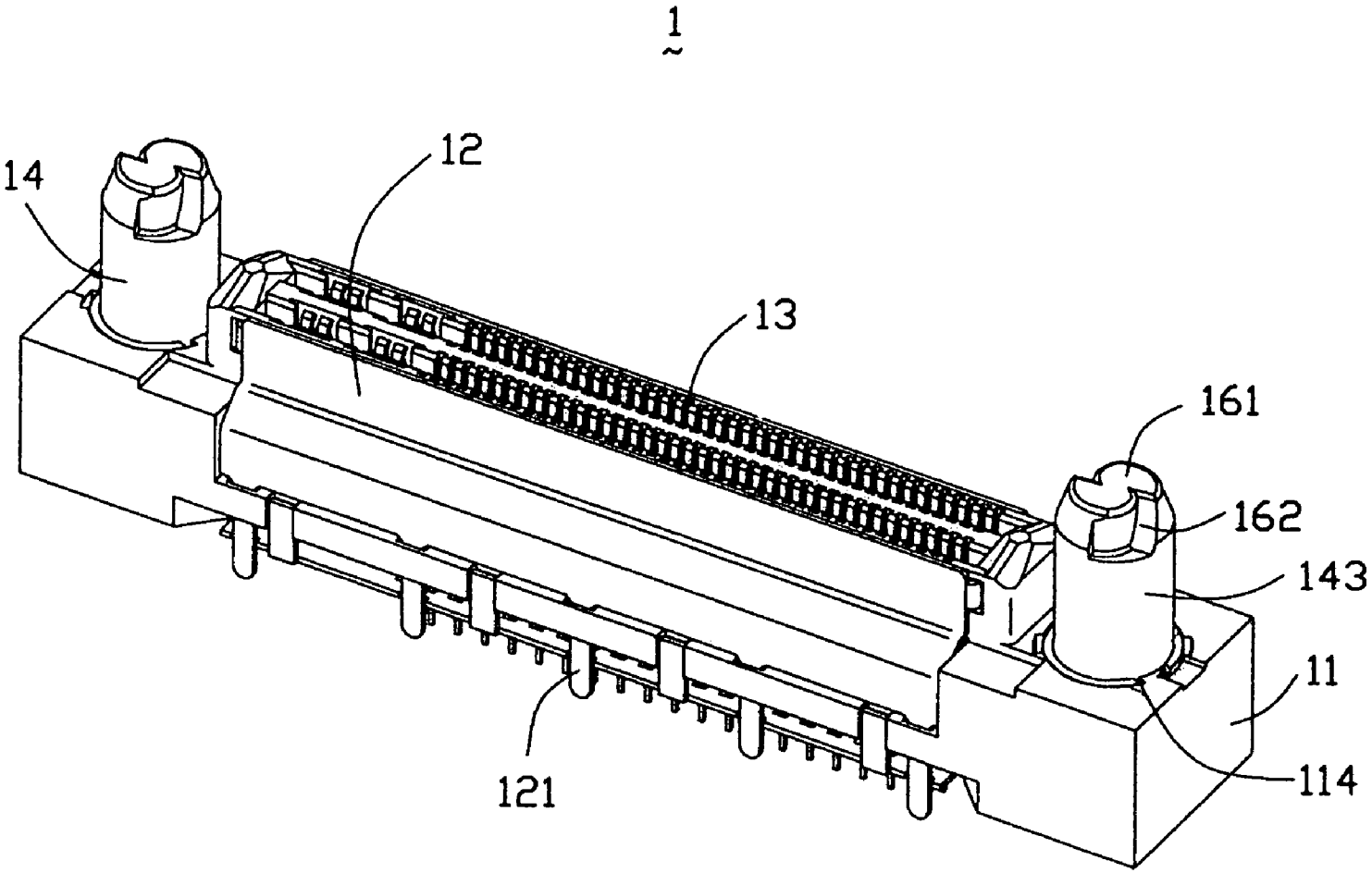
FIG. 4 is a perspective view of a plug with post members for opening the shutter member of the receptacle of FIG. 1.

Referring to FIG. 4, the plug 1 comprises a housing 11, a metallic shielding shell 12, a plurality of contacts 13 received in the housing 11, and a pair of post members 14 respectively provided at two opposite end portion of the housing 11. The shielding shell 12 has a number of grounding legs 121 for being soldered to a PCB (not shown). Tines of the grounding legs 121 and the contacts 13 extend through a bottom surface of the housing 11.

Figure 5:
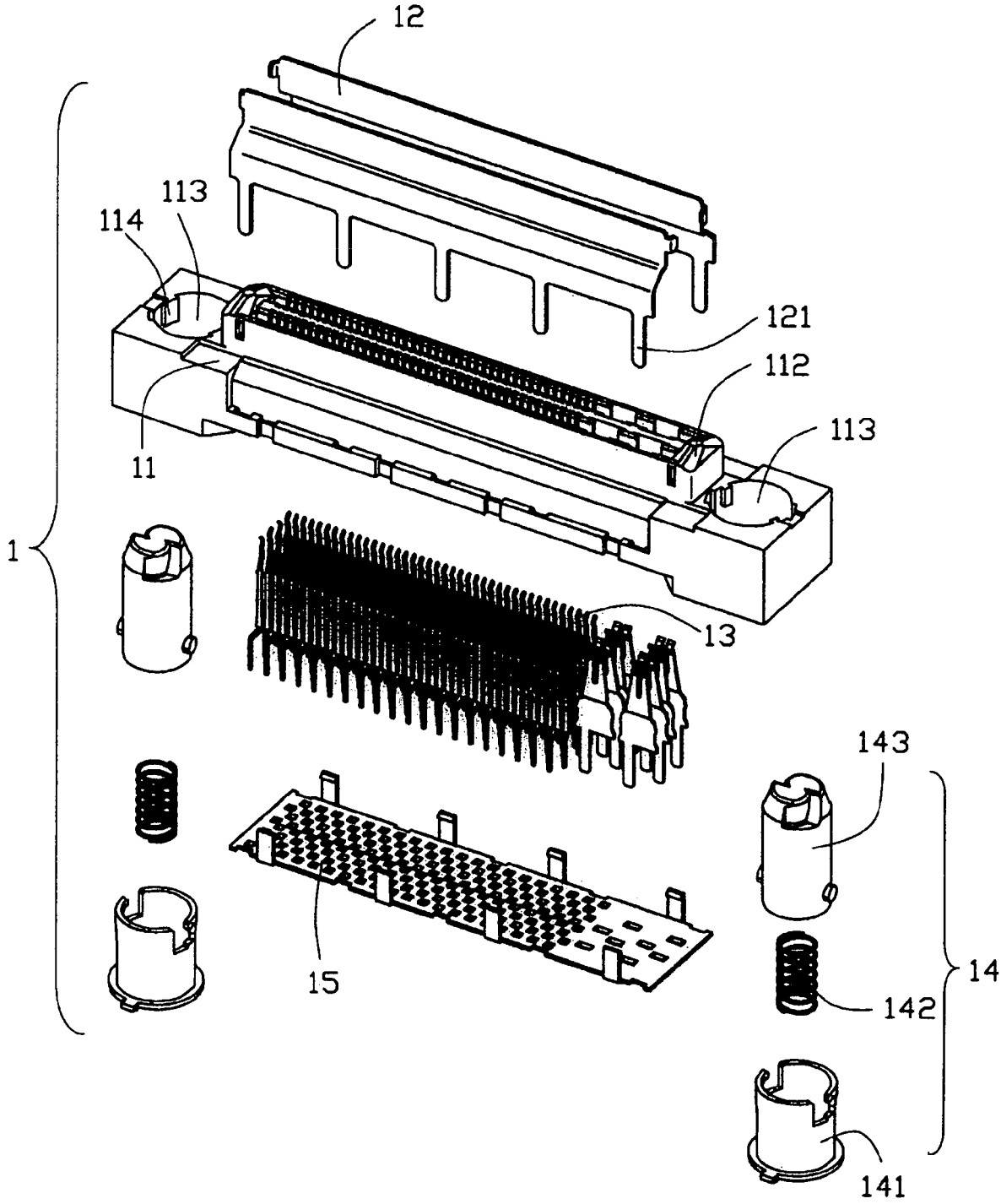
FIG. 5 is an exploded view of the plug of FIG. 4.

Referring to FIG. 5, the plug 1 further comprises a tine plate 15 attached to the tines of the grounding legs 121 and the contacts 13 to align tips of the tines. The mating portion 112 integrally protruding upwards from main body of the housing 11, and a pair of holes 113 respectively defined in two end portions of the housing 11 beside the mating portion 112 for receiving and fastening the post members 14 therein. Contacts 13 are lengthwise arranged in rows in the mating portion 112. Each of the holes 113 has a pair of tubers 114 oppositely protruding from its inner surface.

Each of the post members 14 comprises a fixed portion 141 fixed in the hole 113, a spring member 142, and a movable portion 143. The fixed portion 141 is a metallic annular sleeve and the movable portion 143 is a metallic cylinder partially received in the annular sleeve. The spring member 142 arranged between the fixed portion 141 and the movable portion 143 will push or withdraw the movable portion 143, driving it to move along a mating direction.

Figure 6A:
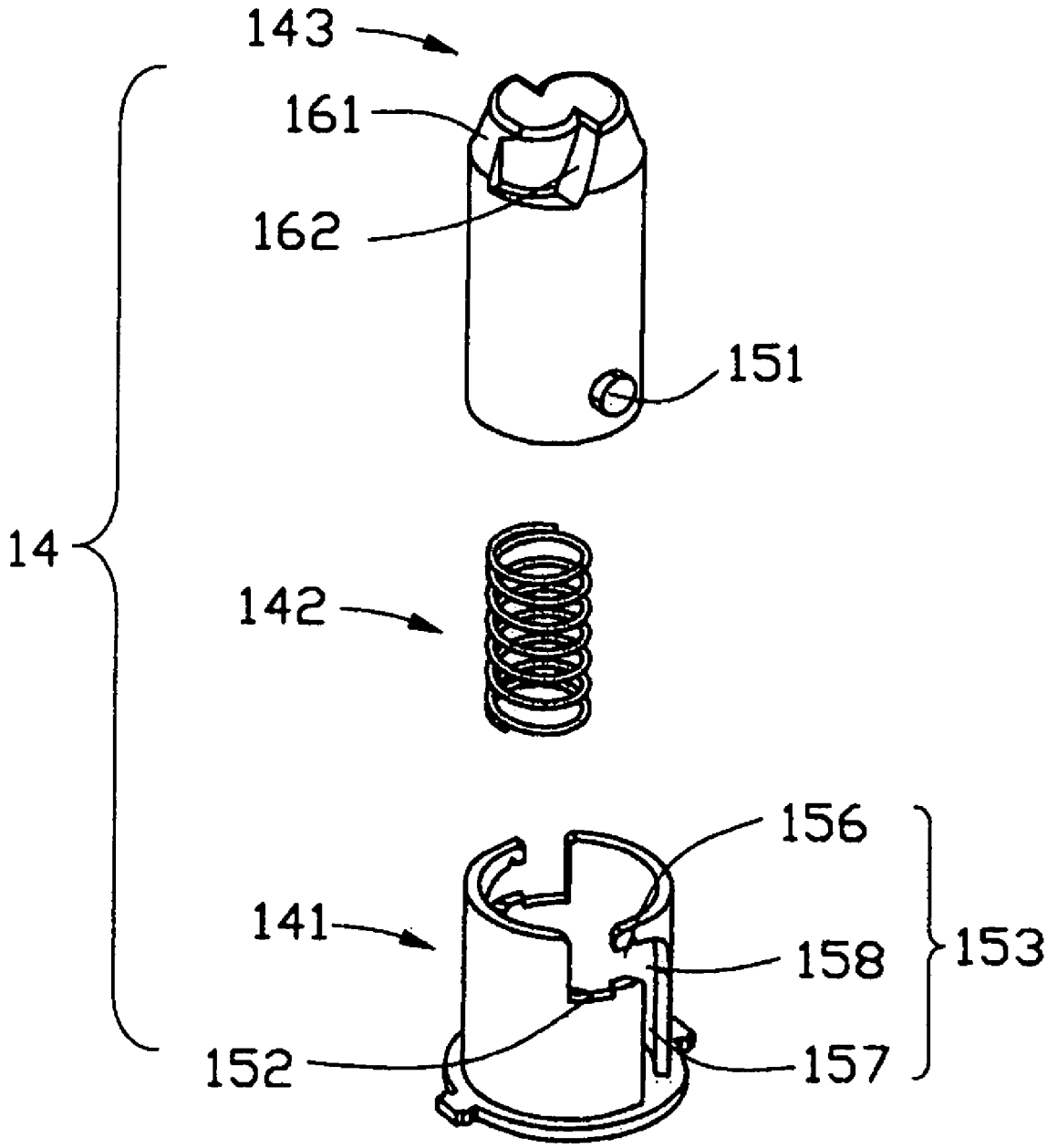
FIG. 6A is an exploded view the post member of the plug of FIG. 5.
Figure 6B:
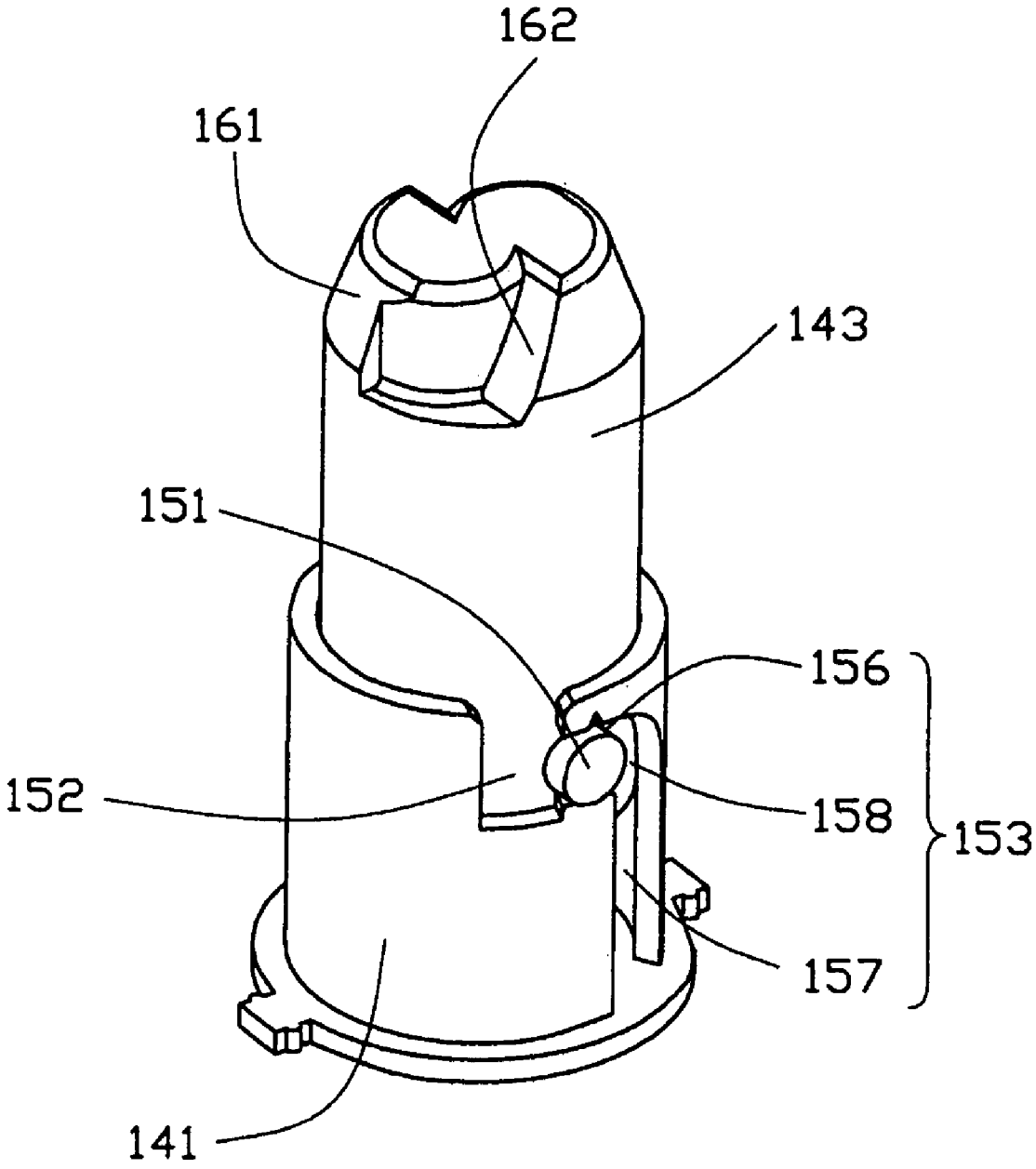
FIG. 6B is an assembly view of the post member of FIG. 6A.

Referring to FIGS. 6A and 6B, the movable portion 143 has a substantially taper-shaped tip portion 161 defining an actuating portion 162 thereon. In this illustrated embodiment, the actuating portion 162 is a pair of guiding slopes symmetrically defined at the tip portion 161 for engaging with the wedgy blocks 218 which function as an actuating member. A pair of cob bulges 151 symmetrically protruding from a lower portion of the movable portion 143 adjacent its bottom face. The fixed portion 141 defines a pair of cutouts 152 corresponding to the tubers 114 on the inner surface of the hole 113 for fixing it therein and a pair of sliding grooves 153 respectively communicating with the cutouts 152. The sliding groove 153 comprises a holding portion 156, a free portion 157 perpendicular to the holding portion 156, and an arc portion 158 joining the holding portion 156 and the free portion 157.

FIG. 6B show the post member 14 in assembly. The cob bulges 151 are fitted flush in the holding portions 156 of the sliding grooves 153 while the lower portion of the movable portion 143 is received in the fixed portion 141.

Figure 7A:
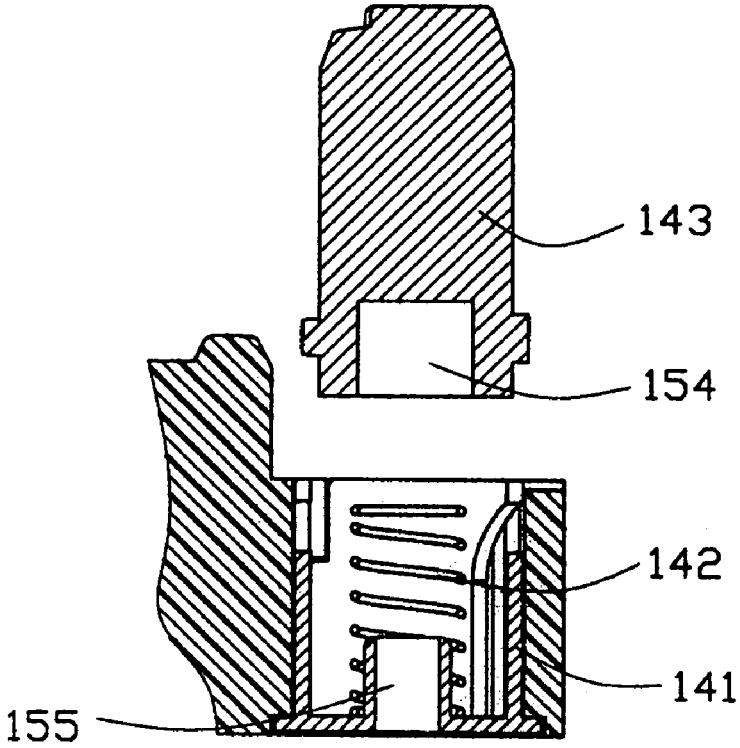
FIG. 7A is a cross-sectional view showing the post member of plug of FIG. 4, wherein a movable portion is separated from a fixed portion thereof.
Figure 7B:
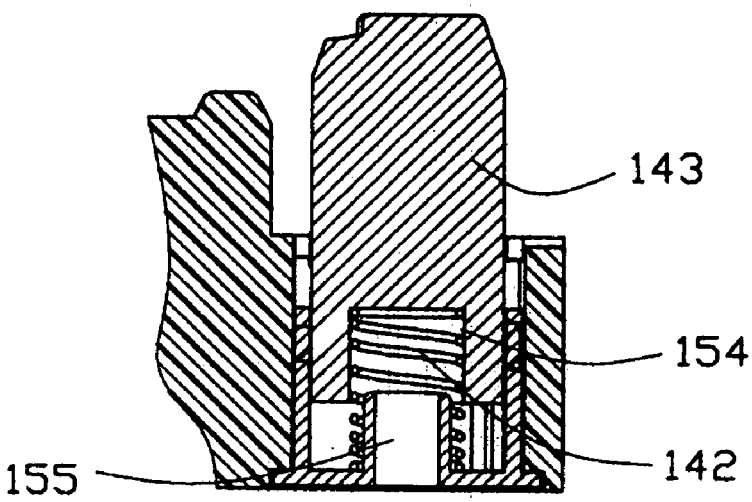
FIG. 7B is a cross-sectional view showing the post member of plug of FIG. 4, wherein the movable portion is assembled to the fixed portion thereof.

Referring to FIGS. 7A and 7B, a cylinder stand 155 rises from an inner bottom face of the fixed portion 141 for fastening one end of the spring member 142 therein. Correspondingly, a downwards-opening receiving recess 154 is defined in a bottom portion of the movable portion 143 for fastening the other end of the spring member 142 therein. The metallic fixed portion 141 is directly connected grounding members of a PCB (not shown).

Figure 8:
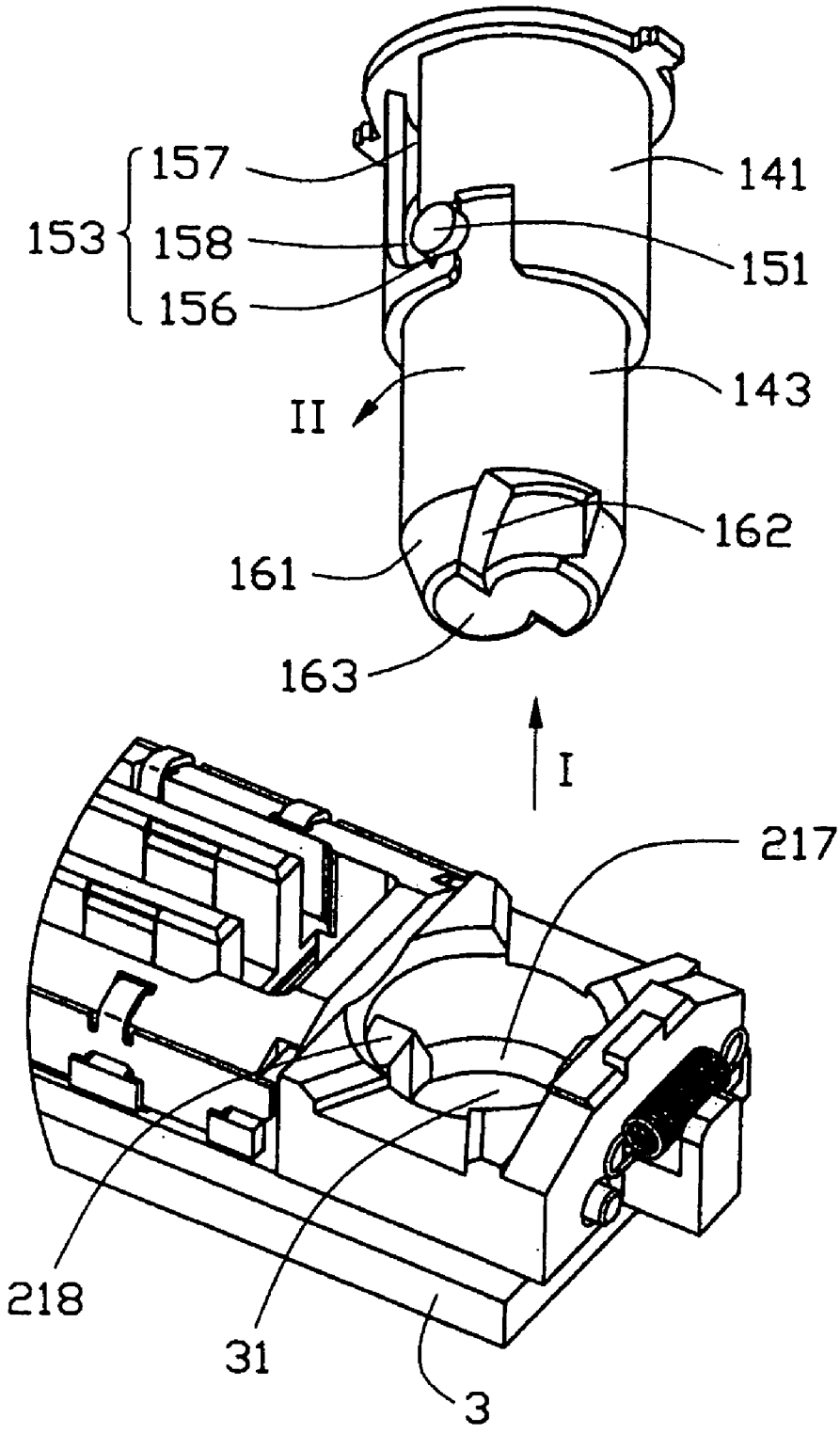
FIG. 8 is a perspective view showing the post member and a guiding hole in the receptacle of FIG. 1 for receiving the post member.

Referring to FIGS. 1, 4 and 8 together, while mating the plug 1 and the receptacle 2 to form a connector assembly, the plug 1 is positioned substantially adjacent to the receptacle 2 such that the tip portion 161 of the post member 14 comes into contact with the guiding plates 241 which is used for guiding the post member 14 to enter the guiding holes 217. Along with advance of the post member 14, the metallic sheets 24*a*, 24*b* are pushed apart to open the shutter member 24 and the plug fitting section 212 of the receptacle 2 is exposed. During this process, the cob bulge 151 on the movable portion 143 is retained in the holding portion 156 of the slide groove 153 and blocked by annular wall of the fixed portion 141 above and under it, making the movable portion 143 be immovable in the mating direction thereby the post member 14 being a relatively rigid body. Thus the post member 14 could provide a force strong enough to open the shutter member to permit the mating portion 112 to enter.

Along with advance of the movable portion 143, the guiding slope (the actuating portion) 162 on the tip portion 161 of the movable portion 143 contacts the wedgy block (the actuating member) 218, then the wedgy block 218 puts a force in a direction I to the guiding slope 162. That force on the guiding slope 162 comes into two different directions that one along a vertical direction and the other along a horizontal direction, wherein the force along the horizontal direction causes the movable portion 143 to rotate along a direction II, synchronously the spring member 142 being twisted. Understandably, under this condition, the movable portion 143 is located at the different transverse/radial position with regard to the initial situation and results in a relative soft manner for movement of the vertical direction. When the bottom terminal of the guiding slope 162 reaches the wedgy block 218, the cob bulge 151 slides exactly to the arc portion 158 of the sliding groove 153 as a result of the rotation of the movable portion 14, and a top face 163 of the movable portion 143 comes into contacting the pad 31 on the PCB 3 under the guiding hole 217. The contact of the metallic movable portion 143 and the pad 31 discharges static electricity in the plug 1 and the receptacle 2. At this time, the contacts 13 and the contacts 23 are not yet in contact. So, by the contact of the movable portion 143 and the pad 31, static electricity is discharged before the electrical connection between the contacts 13 and the contacts 23.

With the plug 1 further fitted, the PCB 3 applies a force to the movable portion 143. The force pushes the movable portion 143 to compress the spring member 142. During this time, the cob bulge 151 slides in the free portion 157 of the guiding groove 153. Thus, after the plug 1 is fitted in the receptacle 2, the movable portion 143 is completely received in guiding hole 217 of the housing 21 of the receptacle 2 without increasing a height dimension of the receptacle 2 or complicating a layout of the PCB 3 by an added requirement to provide a recess to receive the portion of the post member 14 that goes beyond the receptacle 2.

Once the plug 1 is pulled out from the receptacle 2, the post member 14 is drawn out from the guiding hole 217 as well. Then the spring member 142 is apt to return to original free state from the compressed and twisted state, producing two forces respectively opposite the compressing direction and the twisting direction. That makes the movable portion 143 rotate and move back to the original stationary sate while the cob bulge 151 slides back to holding portion 156.

The disclosure is illustrative only, changes may made in detail, especially in matter of shape, size, and arrangement of parts within the principles of the invention. For example, we may make the hole 113 of the housing 11 in the plug 1 be the fixed portion of the post member 14 instead of the metallic sleeve 141.

What is claimed is:

1. An electrical connector comprising:

a housing having a mating portion defining a mating direction and a post member disposed beside the mating portion, the post member including a fixed portion, a movable portion movable relative to the fixed portion, and an elastic portion arranged between the fixed portion and the movable portion, the fixed portion and the movable portion defining a first engaging state where the movable portion is immovable along the mating direction and a second engaging state where the movable portion is free to move along the mating direction; and a plurality of contacts received in the mating portion of the housing, wherein the movable portion has an actuating portion for receiving force to drive the movable portion to move from the first engaging state to the second engaging state along a direction substantially perpendicular to the mating direction, and wherein the elastic member drives the movable portion to come back from the second engaging state to the first engaging state.

2. The electrical connector as described in claim 1, wherein one of the fixed portion and the movable portion has a bulge protruding therefrom, the other of the fixed portion and the movable portion defines a groove comprising a holding portion and a free portion, when the bulge is in the holding portion, the movable portion being in the first engaging state with the fixed portion, and when the bulge is in the free portion, the movable portion being in the second engaging state with the fixed portion.

3. The electrical connector as described in claim 2, wherein the free portion is defined along the mating direction, and the holding portion extends substantially perpendicular to the free portion.

4. The electrical connector as described in claim 2, wherein the bulge is fanned on the movable portion and the groove is defined in the fixed portion.

5. The electrical connector as described in claim 1, wherein the actuating portion is a slope defined on the tip portion of the movable portion.

6. The electrical connector as described in claim 1, wherein the mating direction is a back and forth direction.

7. The electrical connector as described in claim 1, wherein the fixed portion is an annular sleeve fixed in a hole of the housing, the movable portion is a cylinder, and the elastic member is a spring arranged with one end thereof fastened in the annular sleeve and with the other end thereof fastened to an underside of the cylinder.

8. The electrical connector as described in claim 7, wherein the cylinder has a bulge formed from an exterior surface thereof, and the annular sleeve defines a groove in an annular wall thereof.

9. The electrical connector as described in claim 8, wherein the groove comprises a holding portion and a free portion, the free portion being defined along the mating direction, and the holding portion extending substantially perpendicularly to the free portion.

10. The electrical connector as described in claim 9, wherein the annular sleeve defines a cutout communicating wit the groove and functioning as an entry for the bulge to the groove.

11. The electrical connector as described in claim 10, wherein the housing is formed with a protuberance, and wherein the cutout is plugged up by said protuberance after the bulge entering the groove and therefore the post member is assembled to the housing.

12. An electrical connector assembly comprising:

a first connector having a mating connector fitting section with a plurality of contacts therein and a shutter member closing the mating connector fitting section; and a second connector having a mating portion with a plurality of contacts therein and a post member for opening the shutter member to expose the mating connector fitting section of the first connector, the mating portion defining a mating direction, the post member including a fixed portion, a movable portion movable relative to the fixed portion, and an elastic portion arranged between the fixed portion and the movable portion, wherein when the first and second connectors are mated with each other, the fixed portion and the movable portion define a first engaging state where the movable portion is immovable along the mating direction until the shutter member is opened to expose the mating connector fitting section of the first connector and a second engaging state where the movable portion is free to move along the mating direction, wherein the movable portion having an actuating portion for engaging with an actuating member in the first connector to actuate the movable portion to move from the first engaging state to the second engaging state along a direction substantially perpendicular to the mating direction, and the elastic member drives the movable portion to come back from the second engaging state to the first engaging state.

13. The electrical connector assembly as described in claim 12, wherein the actuating portion is a slope defined on the tip portion of the movable portion.

14. The electrical connector assembly as described in claim 12, wherein the first connector defines a guiding hole for guidingly receiving the post member of the second connector.

15. The electrical connector assembly as described in claim 14, wherein the actuating member is a wedgy block formed in each guiding hole.

16. An electrical connector assembly comprising:

a first electrical connector defining a first insulative housing with a plurality of first contacts therein;

a moveable post formed on the first insulative housing;

a second electrical connector defining a second insulative housing with a plurality of second contacts therein; and a moveable shutter member applied unto the second insulative housing for protecting a mating port of the second housing when said first connector and said second connector are unmated with each other; wherein when the first connector and the second connector are mated with each other, the post initially is located at a first transverse position and performs a relatively stiff manner to efficiently actuate the shutter member to move for opening of said mating port, and successively is moved to a second transverse position and performs a relative soft manner to allow the post to be retracted so as not to increase an assembly height of the mated first and second connectors.

17. The assembly as claimed in claim 16, wherein at least one of said post and said second housing defines a sliding structure to guidably move the post to said different transverse positions.

18. The assembly as claimed in claim 17, wherein said second housing defines a guiding hole to receive said post, and said sliding structure is formed on at least one of said post and said guiding hole.

* * * * *